US010500592B2

(12) United States Patent
Chen et al.

(10) Patent No.: US 10,500,592 B2
(45) Date of Patent: Dec. 10, 2019

(54) ROLLER MILL SYSTEM WITH REJECTS REMOVAL SYSTEM

(71) Applicant: ARVOS Inc., Wellsville, NY (US)

(72) Inventors: Michael M. Chen, Naperville, IL (US); Felipe H. Giacomazzi, São Paulo (BR)

(73) Assignee: Schenck Process LLC, Sabetha, KS (US)

( * ) Notice: Subject to any disclaimer, the term of this patent is extended or adjusted under 35 U.S.C. 154(b) by 643 days.

(21) Appl. No.: 15/079,696

(22) Filed: Mar. 24, 2016

(65) Prior Publication Data

US 2017/0274387 A1 Sep. 28, 2017

(51) Int. Cl.

| | |
|---|---|
| ***B02C 23/30*** | (2006.01) |
| ***B02C 15/04*** | (2006.01) |
| ***B02C 15/02*** | (2006.01) |
| *B02C 15/00* | (2006.01) |

(52) U.S. Cl.

CPC ..... *B02C 23/30* (2013.01); *B02C 15/02* (2013.01); *B02C 15/04* (2013.01); *B02C 15/045* (2013.01); *B02C 15/001* (2013.01); *B02C 2015/002* (2013.01)

(58) Field of Classification Search

CPC ..... B02C 23/30; B02C 15/02; B02C 15/04; B02C 15/045; B02C 15/011; B02C 2015/002

USPC ..... 241/119, 219, 131

See application file for complete search history.

(56) References Cited

U.S. PATENT DOCUMENTS 801,572 A * 10/1905 Davis ..... B02C 17/18 209/477
2,108,609 A * 2/1938 O'Mara ..... B02C 15/02 209/139.1
2,151,253 A * 3/1939 Whitney ..... B65G 33/32 198/676
3,770,124 A 11/1973 Frangquist
3,951,347 A * 4/1976 Tiggesbaumker .... B02C 15/007 241/52
4,597,537 A * 7/1986 Misaka ..... B02C 15/04 241/119

(Continued)

OTHER PUBLICATIONS

International search report for corresponding PCT/US2017/023560 dated Jun. 27, 2017.

*Primary Examiner* — Adam J Eiseman
*Assistant Examiner* — Bobby Yeonjin Kim
(74) *Attorney, Agent, or Firm* — Murtha Cullina LLP

(57) ABSTRACT

A roller mill system includes a vessel having an inlet, an outlet, a grinding zone and a classifier zone. The grinding zone includes a grinding assembly configured for grinding the material into fine particles. The grinding zone also includes a rejects capture and discharge system that includes one or more discharge conduits for conveying rejects away from the vessel. The rejects capture and discharge system includes: 1) a collection trough located under the grinding assembly and in communication with one of the discharge conduits, for discharging rejects from the grinding zone; and/or 2) a turbine classifier mounted in the classifier zone. The turbine classifier is rotatable about a central axis. Another outlet is formed in a side wall of the classifier zone. The turbine classifier is configured to expel the rejects radially outward therefrom, through the side wall outlet and into another one of the discharge conduits.

32 Claims, 9 Drawing Sheets

(56) References Cited

U.S. PATENT DOCUMENTS 5,330,110 A * 7/1994 Williams ..... B02C 15/02 241/119
5,826,807 A * 10/1998 Csendes ..... B01D 45/14 241/19
5,957,300 A * 9/1999 Nardi ..... B02C 15/001 209/139.2
6,820,829 B1 * 11/2004 Oder ..... B02C 15/04 241/119
7,267,293 B2 * 9/2007 Chen ..... B02C 15/001 241/117
7,358,024 B2 4/2008 Naka et al.
7,913,851 B2 * 3/2011 Chang ..... B02C 15/003 209/139.1
2004/0182957 A1 * 9/2004 Gomez ..... B01J 8/0015 241/39
2005/0139701 A1 * 6/2005 Naka ..... B02C 23/10 241/5
2005/0242008 A1 * 11/2005 Simpson ..... B01D 45/12 209/717
2006/0049288 A1 * 3/2006 Kronz ..... B02C 15/00 241/19
2009/0121056 A1 * 5/2009 Chen ..... B02C 15/02 241/52
2014/0076210 A1 * 3/2014 Daimaru ..... F23K 3/02 110/222
2014/0306044 A1 * 10/2014 Guenter ..... B07B 4/04 241/42
2015/0053800 A1 * 2/2015 Bourgeois ..... B02C 4/02 241/49
2016/0001327 A1 * 1/2016 Hagemeier ..... B07B 7/083 241/101.5
2016/0045841 A1 * 2/2016 Kaplan ..... B01J 19/0093 429/49

* cited by examiner

ROLLER MILL SYSTEM WITH REJECTS REMOVAL SYSTEM

TECHNICAL FIELD

The present invention is directed to a roller mill system for producing fine ground particles, and more specifically to such a roller mill system having a bottom discharge port and/or a turbine classifier with a side discharge port for removal of rejects, such as grit, from a stream of particles being processed in the mill.

BACKGROUND

Various types of grinding mills are typically employed to grind solid materials such as minerals, clay, limestone, gypsum, phosphate rock, salt, coke, biomass and coal into small particles for use in a wide range of processes such as for combustion in furnaces and for chemical reactions in reactor systems. There are many types and configurations of grinding mills including ball mills, roller mills and bowl type vertical grinding mills. The ball mills typically include a horizontal rotating cylinder containing a charge of tumbling or cascading balls. One exemplary type of roller mill is a pendulum mill which includes a support shaft rotationally supported by a bearing housing. One end of the shaft is coupled to a drive unit for rotating the shaft. An opposing end of the shaft has a hub mounted thereto. A plurality of arms extend from the hub. Each of the arms pivotally supports a roller journal which has a roller rotatingly coupled to an end thereof. The rollers rollingly engage the grinding ring. During operation of the roller mill, centrifugal forces drive the crushing members against the grinding ring. The crushing members pulverize the solid material against the grinding ring as a result of contact with the grinding ring.

As shown in FIG. 1, a roller mill 100 includes, for example, a vessel 110 in which a bowl assembly 112 is mounted. As shown in FIG. 1, the exemplary roller mill 100 include grinding rollers 118 each mounted on a suitably supported journal 120. The journals 120 are connected for rotation to a drive shaft 122 via support arms 121. The grinding rollers 118 interact with a grinding surface of the bowl assembly 112 to effect the grinding of material interposed therebetween. After being pulverized, the particles of material are thrown outwardly by centrifugal force whereby the particles of material are fed into a stream of air that is entering the mill 100 via an annular manifold 117. The flow of air is through the mill 100 is caused by a fan 119 that is in communication with a discharge duct 123 of the mill 100. The fan 119 circulates air and pulverized fine particles entrained in the air into a separator 125 (e.g., a cyclone separator or bag house) that separates the fine particles and discharges them via an outlet 125D. Circulating air that has most of the fine particles removed therefrom is discharged from the separator 125 via the clean air port 125A and circulated back to the annular manifold 117.

Prior art mills 100 typically employed a classifier 130 in a classifier section of the mill 100 located downstream of the grinding rollers 118 and upstream of the fan 119 proximate the discharge duct 123 of the mill 100. The stream of air with the particles of material entrained therein flows into a classifier 130 in which coarse particles of material are intended to be rejected from the air stream. These coarse material particles are then supposed to be returned to the grinding area for further pulverization, while the fine particles of material are supposed to be carried through the mill 100 in the air stream, and exit along with the air.

As shown in FIGS. 2 and 3 one prior art classifier 130 is known as a "whizzer separator" as disclosed in U.S. Pat. No. 2,108,609. One of the prior art classifiers 130 may be employed for the classification of the coarse particles or two or more of the prior art classifiers 130 may be employed in a series configuration. The prior art classifier 130 includes a closed central disc 138 that is secured to a rotatable shaft 130S. A plurality of blades 139 extend radially outward from the disc 138. The blades 139 are beveled inwardly and upwardly thereby defining an inclined edge 140. A conical deflector 141 is secured to a wall 130W of the classifier section of the mill 100. The conical deflector 141 defines a outwardly and downwardly sloped surface 141C. The inclined edge 140 of the blades 139 rotate in close proximity to the sloped surface 141C. There is a gap G between the sloped surface 141C and the inclined edge 140. During operation of the prior art classifier 130, air and pulverized particles entrained in the air flow through spaces 142 between adjacent blades 139. There is no flow through the central portion of the prior art separator 130 due to the presence of the disc 138.

The applicant has conducted computational fluid dynamics (CFD) analysis on the prior art classifiers 130 to determine particle velocity distributions upstream and downstream of the classifier and to determine particle size distribution. The CFD analysis demonstrated that the velocity profile of the particles upstream of the prior art classifier 130 were substantially straight and vertical with essentially no tangential velocity component or swirl. Such a velocity profile allow all sized particles, larger or small, to approach and enter the prior art classifier 130, without rejecting any of the larger particles. Thus, the separation mechanism for the prior art separator is via a "shutter effect" of the particles impinging the blades 139. For example, the substantially straight and vertical velocity profile may cause the larger particles to exit the classifier, if they hit the blades 139.

The CFD also demonstrated a strong vortex and recirculation zone downstream of the blades 139 in the prior art classifier 130. Such a vortex and recirculation zone allows a substantial amount of the small particles (e.g., including 10 micron particles) that are supposed to exit the classifier to recirculate back into the mill 100. The recirculation of the small particles back into the mill 100 reduces the efficiency and output of the prior art classifier 130.

In addition, due to the close proximity of the inclined edges 140 of the blades 139 to the sloped surface 141C of the conical deflector 141, the inclined edges 140 of the blades 139 and/or the sloped surface 141C of the conical deflector 141 tend to wear and decrease the effectiveness of the prior art classifier 130. The close proximity of the inclined edges 140 of the blades 139 to the sloped surface 141C of the conical deflector 141 creates alignment difficulties during assemble and operation. Furthermore, the prior art separator 130 is not configured to remove the heavier particles from the mill 100, but instead merely returns them to the area of the grinding rollers 118 for further grinding. This can cause operational problems with the mill as heavy and grit and hard particles such as raw sand and ground sand are maintained in the mill 100. Moreover, the prior art separator 130 cannot distinguish or separate particles based on density of the particles. As a result, the prior art separator 130 cannot distinguish or separate grit from heavy material particles suitable to be re-ground. As a result, the prior art separators discharge a mixture that contains up to about 25 weight percent undesirable materials, such as sand, grit and other larger and high density particles, with the remainder (about 75 weight percent) being the material intended to be ground. Thus, 75 percent or more of the material discharged and rejected from the roller mill 100 as waste is the useable material intended to be ground.

There is a need for an improved mill and separator system that can distinguish and separate undesirable particles from material intended to be ground and to achieve a discharge mixture that contains a higher percentage of the undesirable materials.

SUMMARY

In one aspect, there is disclosed herein a roller mill system for grinding material into fine particles. In one non-limiting exemplary embodiment, the roller mill system is a pendulum mill system. The roller mill system includes a vessel having a first inlet and a first outlet. The vessel is configured for flow of a gas from the first inlet to the first outlet. The vessel includes a grinding zone and a classifier zone located downstream of the grinding zone. The vessel may include a second inlet for feeding the material into the vessel. The grinding zone may be proximate to the first inlet. The grinding zone includes a grinding assembly configured for grinding the material into fine particles. The grinding zone also includes a rejects capture and discharge system that includes one or more discharge conduits for conveying rejects away from the vessel. The rejects capture and discharge system includes: 1) a collection trough located under the grinding assembly and in communication with one of the discharge conduits, for discharging rejects from the grinding zone; and/or 2) a turbine classifier mounted in the classifier zone. The turbine classifier is rotatable about a central axis. A second outlet is formed in a side wall of the classifier zone. The turbine classifier is configured to expel the rejects radially outward therefrom, through the second outlet and into another one of the discharge conduits.

In one embodiment, the rejects capture and discharge system further includes a pressure control line in fluid communication with one or more of the discharge conduits. The pressure control line is configured to decrease pressure in the discharge conduit to a magnitude less than that in the grinding zone. In one embodiment, the pressure control line is in fluid communication with the classifier zone which is operated at a lower pressure than the grinding zone. In one embodiment, the pressure control line includes one or more valves therein for controlling pressure in the discharge conduit. In one embodiment, the pressure control line is fluid communication with a vacuum source.

In one embodiment, the discharge conduit of the rejects capture and discharge system includes a conveyor for purging flow of the rejects out of the discharge conduit. For example, the conveyor of the rejects capture and discharge system may include a vibrator and/or a rotating screw.

In one embodiment, the turbine classifier includes a plurality of vanes extending between an annular ring and a solid disc. The plurality of vanes are arranged radially outward from a central axis of the annular ring and solid disc. The solid disc blocks flow into a bottom portion of the turbine classifier and the annular ring defining an opening therein for discharge of fine ground particles therethrough.

In one embodiment, the roller mill system includes a flow diversion flap moveably secured to the side wall of the roller mill at the second outlet and extends into the classifier zone. The flow diversion flap is configured to divert the rejects through the second outlet thereby exiting the classifier zone.

In one embodiment, the roller mill system includes a duct secured to an outside portion of the side wall. The duct is positioned over the second outlet to convey the rejects outwardly from the classifier zone. In one embodiment, the duct has a backflow control damper positioned thereon for controlling flow of the rejects through the duct and to allow the fine particles to flow back into the classifier zone. In one embodiment, the duct include a plurality of perforated plates positioned in the duct to establish a uniform backflow of the fine particles back into the classifier zone.

In one embodiment, the turbine classifier has a first diameter and the side wall of the classifier has a second diameter. The first diameter is about 40 to 80 percent of the second diameter. In one embodiment, the first diameter is about 55 to 65 percent of the second diameter. In one embodiment, the outside diameter D1 of the turbine classifier 30 is about 60 percent of the inside diameter D2 of the side wall 10W.

The rejects capture and discharge system is configured to remove only those particles having a density or size greater than a predetermined magnitude.

DETAILED DESCRIPTION

Figure 4:
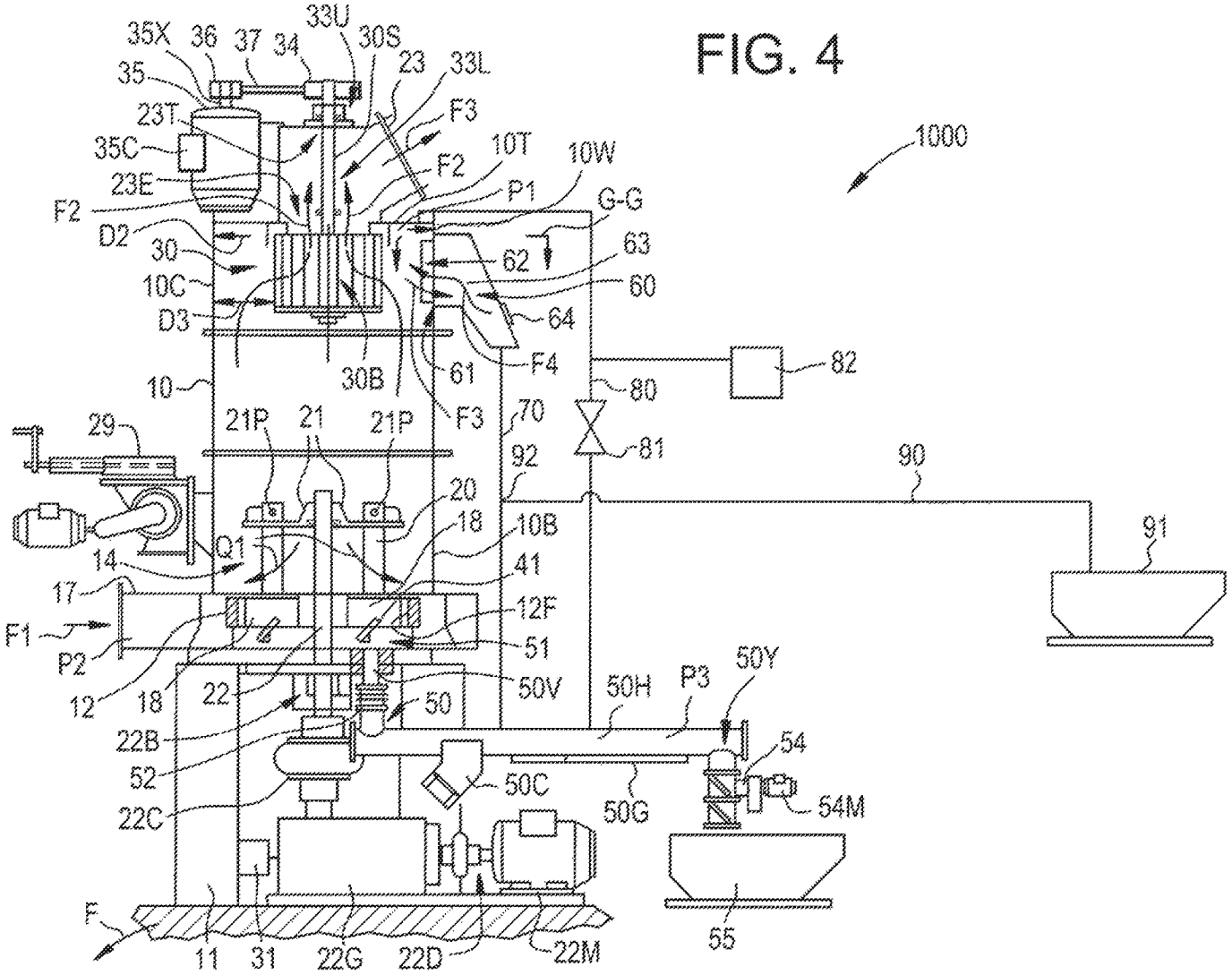
FIG. 4 is a schematic view of the roller mill system of the present invention having a collection trough located under the mill and a discharge conduit.

As shown in FIG. 4, a roller mill system of the present invention is generally designated by the numeral 1000. The roller mill system 1000 shown and described in FIG. 4 is a pendulum mill that is referred to herein, by way of example, as one type of roller mill that can employ the present invention. However, the present invention is not limited in this regard as other types of roller mills may employ the present invention. The roller mill system 1000 includes a vessel 10 fixedly secured to a frame 11. A bowl assembly 12 is mounted in a grinding zone 10B located at a lower portion of the vessel 10. The roller mill system 1000 includes a grinding assembly 14 mounted in the grinding zone 10B of the vessel 10 proximate the bowl assembly 12 for grinding a material into fine particles. The grinding assembly 14 includes a plurality of rollers 18 each mounted on a suitably supported journal 20. The journals 20 are pivotally connected to a support arms 21 via respective pivot joints 21P. The support arms 21 are connected for rotation to a drive shaft 22. The drive shaft 22 is supported for rotation relative to the frame 11 by a bearing assembly 22B. The drive shaft 22 is connected to a speed control unit 22G (e.g., a gear box) via a coupling 22C. A motor 22M is connected to the speed control unit 22G via a drive coupling assembly 22D. The frame 11, the speed control unit 22G and the motor 22M are fixedly secured to a foundation F. In one embodiment, a plurality of plows 41 that facilitate the direction of material to be ground into the bowl assembly 12.

The vessel 10 has a turbine classifier 30 rotatably mounted in a classifier zone 10C of the vessel 10 coaxially therewith. The classifier zone 10C is located downstream of the grinding assembly 14 and the grinding zone 10B of the vessel 10. Thus, the grinding zone 10B, the grinding assembly 14, the classifier zone 10C and the turbine classifier 30 all coexist in the same vessel 10. The turbine classifier 30 includes a body portion 30B that is fixedly secured to a drive shaft 30S that is mounted for rotation relative to the vessel 10, via a lower bearing 33L and an upper bearing 33U. The drive shaft 30S extends through an entrance opening 23E into the discharge duct 23 proximate a top portion 10T of the vessel 10. The drive shaft 30S extends through an interior of the discharge duct 23 and out through an opening 23T in the discharge duct 23. A first drive disc 34 (e.g., a gear, pulley or sheave) is fixedly secured to a distal end of the drive shaft 30S. A motor 35 is fixedly mounted (i.e., relative to the foundation F) at a location adjacent to the drive shaft 30S. The motor 35 has a motor drive shaft 35X extending therefrom and rotatable relative to the motor 35 upon operation of the motor 35. In one embodiment, the motor 35 is controlled by a control unit 35C (e.g., a computer processor control system). A second drive disc 36 is fixedly secured to a distal end of the drive shaft 35X. A linkage 37 (e.g., a belt or chain) drivingly couples the first drive disc 34 to the second drive disc 36 so that rotation of the drive shaft 35X is transmitted to the drive shaft 30S of the turbine classifier 30.

Figure 1:
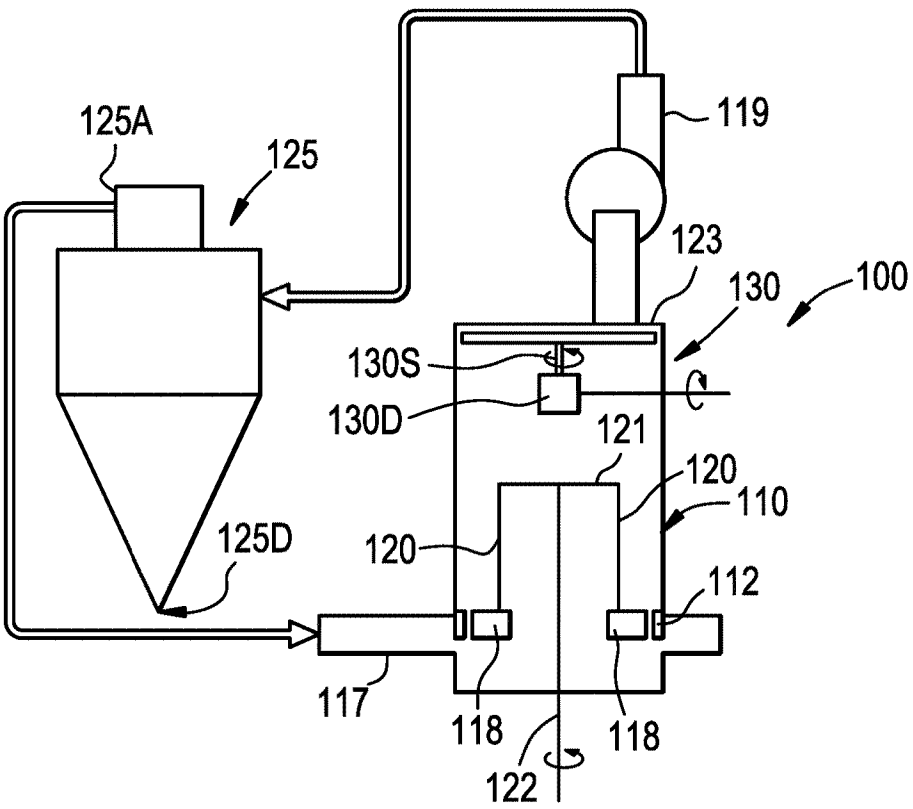
FIG. 1 PRIOR ART
FIG. 1 is a schematic diagram of a prior art roller mill, fan and cyclone separator.
Figure 2:
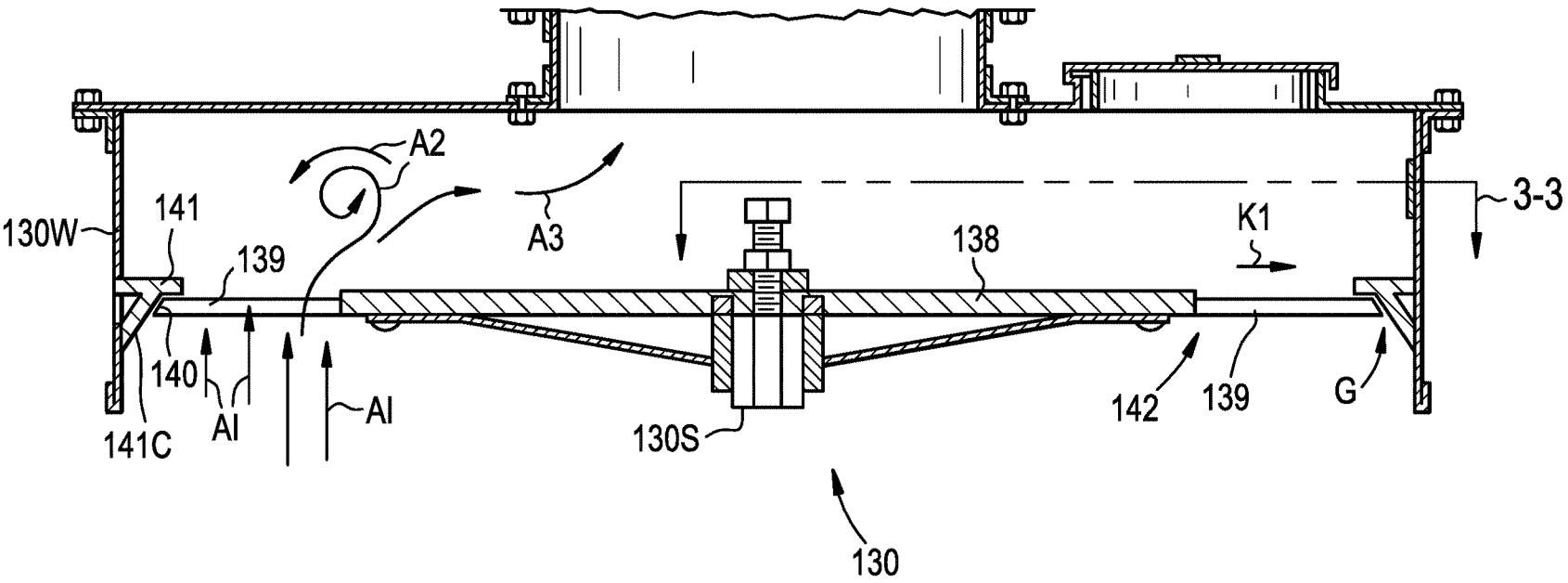
FIG. 2 PRIOR ART
FIG. 2 is and enlarged cross sectional view of a classifier section of the prior art mill of FIG. 1.
Figure 3:
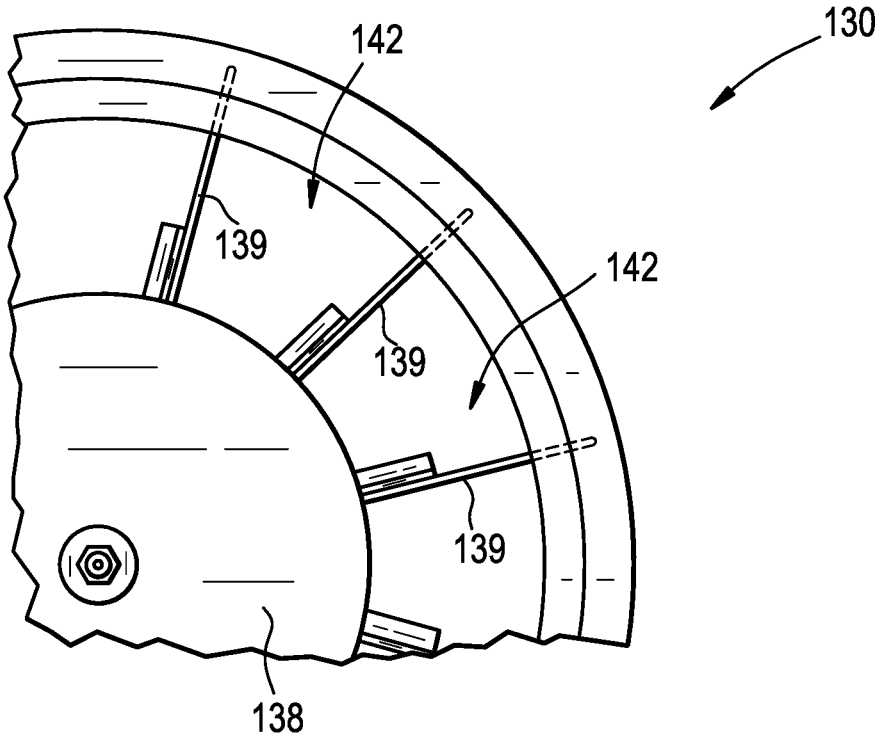
FIG. 3 PRIOR ART
FIG. 3 is top view of a portion of the prior art classifier of FIG. 2 taken across line 3-3 of FIG. 2.

During operation, material to be pulverized is fed into the vessel 10 via a feeder unit 29 (i.e., a second inlet into the vessel 10) and the motor 22M rotates the drive coupling assembly 22D which causes rotation of gears (not shown) housed within the speed control unit 22G. The speed control unit 22G is controlled by a control unit 31 (e.g., a computer processor control system) to create a predetermined and variable output speed of the drive shaft 22. As a result, the support arms 21 rotate with the shaft 22 and cause the journals 20 to swing radially outward in the direction indicated by the arrows Q1 about the pivot connections 21P, thereby causing the rollers 18 to rolling engage a radially inward facing grinding surface 12F of the bowl assembly 12. The grinding rollers 18 interact with the grinding surface 12F of the bowl assembly 112 to effect the grinding of material interposed therebetween. After being pulverized, the particles of material are thrown outwardly by centrifugal force whereby the particles of material are fed into a stream of air as indicated by the arrow F1 that is entering the vessel 10 via an annular manifold 17 (i.e., a first inlet to the vessel) that is proximate the grinding zone 10B. The flow of air is through the vessel 10 is caused by a fan (not shown, but similar to the fan 119 illustrated in FIG. 1) that is in communication with a discharge duct 23 (i.e., a first outlet) of the vessel 10. The fan creates a pressure P2 in the annular manifold 17 and the grinding zone 10B; creates a lower pressure P1 in the clarifier zone 10C. The fan circulates air and pulverized fine particles entrained in the air into a separator (not shown but similar to the separator 125 e.g., a cyclone separator or bag house illustrated in FIG. 1) that separates the fine particles and discharges them via an outlet. Circulating air that has most of the fine particles removed therefrom is discharged from the separator via a clean air port similar to the clean air port 125A of FIG. 1 and circulated back to the annular manifold 17.

The roller mill system 1000 includes a rejects capture and discharge system (e.g., sub-system) that includes a discharge conduit for conveying the rejects away from the vessel 10. As used herein, the term "rejects" means a discharge of a mixture of: 1) undesirable materials such as high density hard sand, silica and grit particles (e.g., having diameters greater than 150 microns, for example 200 to 250 microns and greater) that are not intended to be ground and other such particles that could damage the roller mill system 1000; along with 2) some of the material to be ground. The present invention is directed, in one aspect, to maximizing the percentage of undesirable materials in the rejects.

In one embodiment, the rejects capture and discharge system includes a collection trough 51 located under the grinding assembly 14 at a bottom portion of the vessel 10, for discharging rejects from the grinding zone 10B. In this embodiment, the discharge conduit includes: 1) a grinding zone discharge conduit 50 that is in communication with (e.g., connected to) the collection trough 51; and 2) a horizontal conveyor section 50H. The grinding zone discharge conduit 50 has a vertical section 50V that has a valve 52 positioned therein for regulating (e.g., terminating, initiating and/or throttling flow) the flow of rejects through the grinding zone discharge conduit 50. The grinding zone discharge conduit 50 is connected to the horizontal conveyor section 50H of the discharge conduit. The horizontal conveyor section 50H extends outwardly from the vertical section 50V. The horizontal conveyor section 50H includes a conveyor assist device such a vibration generator 50G to urge or purge the rejects through the grinding zone discharge conduit 50. While, the conveyor assist device is described as being a vibration generator 50G, the present invention is not limited in this regard as other configurations of the conveyor assist device may be employed including but not limited to a screw conveyor as shown in FIG. 4.

An outlet end 50Y of the grinding zone discharge conduit 50 has a valve 54 disposed therein (e.g., terminating, initiating and/or throttling flow) the flow of rejects through the grinding zone discharge conduit 50. In one embodiment, the valve 54 is a double flapper type valve that has a motor actuator 54 thereon for controlling the position (e.g., open, closed or intermediate position) of the valve 54. The rejects are discharged through the valve 54 into a collecting vessel 55 such as an open top moveable rail car.

In one embodiment, the rejects capture and discharge system includes: 1) a turbine classifier 30 rotatably mounted in the classifier zone 10C for separating rejects from the material to be ground; and 2) an opening 61 (e.g., a second outlet) formed in a side wall 10W of the classifier zone 10C, for collecting and discharging the rejects from the classifier zone 10C. In this embodiment, the discharge conduit includes a classifier zone discharge conduit 70 that is in communication with the classifier zone 10C via the opening 61. The discharge conduit 70 is connected to the horizontal conveyor section 50H. The turbine classifier is configured to expel the rejects radially outward therefrom, through the opening 61 and into the classifier zone discharge conduit 70. In one embodiment, the classifier zone discharge conduit 70 includes a branch connection 92 which is connected to another discharge line 90 configured to discharge the rejects into another container 91 (e.g., a rail car).

Figure 6:
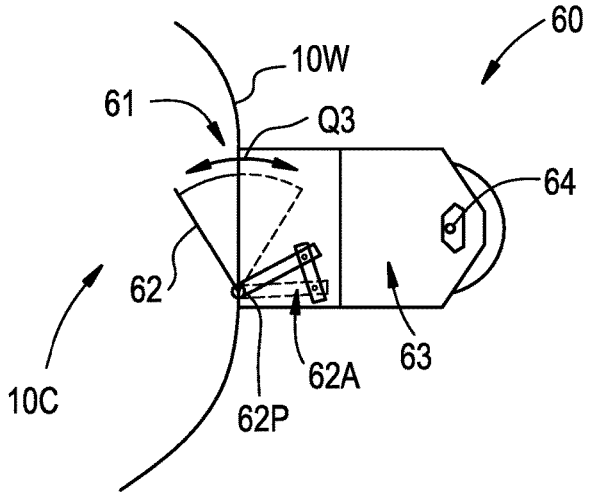
FIG. 6 is a top sectional view of the flow diversion flap of FIG. 4 taken across line 6-6 of FIG. 4.

In one embodiment, a rejects collection device 60 (e.g., a duct) is located outside of the vessel 10, positioned over the opening 61 and secured to an outside portion of the side wall 10W to convey rejects outwardly from the classifier zone 10C as indicted by the arrow F3. As best shown in FIG. 6, the rejects collection device 60 includes a scoop 62 (e.g., a flap) that extends into the classifier zone 10C through the opening 61 and a duct formed body 63 that extends outwardly from the side wall 10W. The scoop 62 is pivotable about a hinge 62P in the direction indicated by the arrow Q3. A actuator 62A is in communication with the scoop 62 for positioning the scoop 62 at a predetermined position based on the amount, velocity and physical characteristics (e.g., density, particle size) of the rejects.

Figure 5:
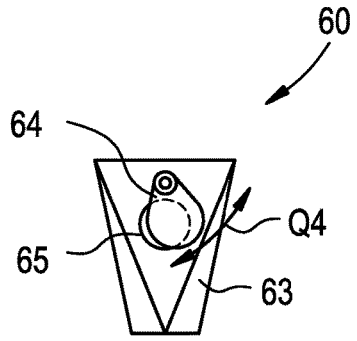
FIG. 5 is a front view of the backflow control damper of the roller mill system of FIG. 4.

As shown in FIGS. 5 and 6 the rejects collection device 60 includes a backflow control damper 64 (e.g., slidable flap, valve, hinged door or the like) that is moveably positioned over an opening 65 in the duct formed body 63, for controlling flow of the rejects through the duct and to allow the fine particles (e.g., those intended to be ground and used as a viable output of the mill) to flow back into the classifier zone by causing a backward flow of air through the opening and into the classifier zone 10C, as indicated by the arrow F4 as illustrated in FIG. 4.

Figure 7:
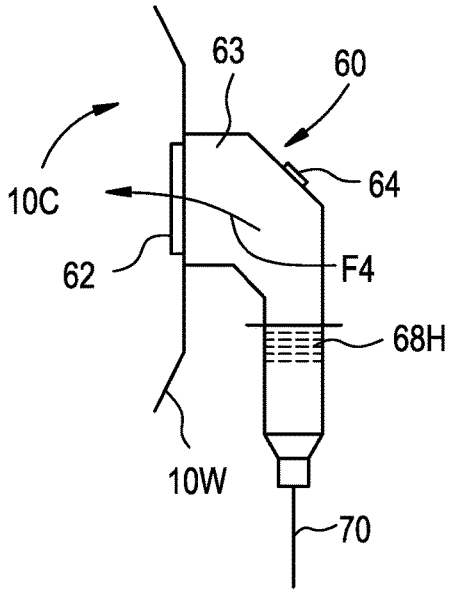
FIG. 7 is a side schematic view of the throw-out duct of the roller mill system of FIG. 4.
Figure 8:
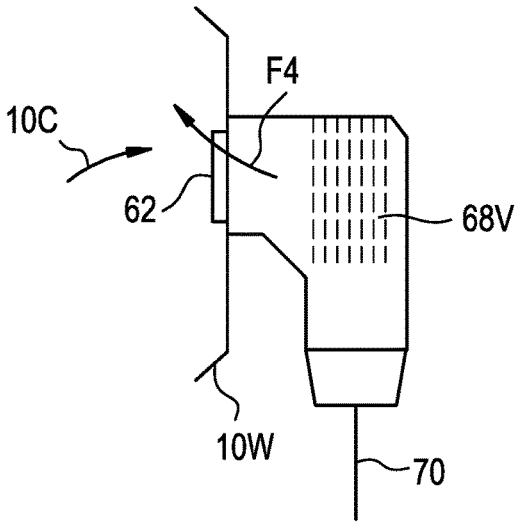
FIG. 8 is a side schematic view of another embodiment of the throw-out duct of the roller mill system of FIG. 4.

As illustrated in FIG. 7, the rejects collection device 60 includes a plurality of horizontal perforated plates 68H located outside of the vessel 10 and positioned in the rejects collection device 60 to establish a uniform backflow of the fine particles back into the classifier zone 10W as indicated by the arrow F4. While the perforated plates 68H are described as being horizontal, the present invention is not limited in this regard as other configurations may be employed including, but not limited to vertical perforated plates 68V located outside of the vessel 10 and as shown in FIG. 8 and combinations of the horizontal perforated plates 68H and vertical perforated plates 68V located outside of the vessel 10.

As illustrated in FIG. 4, in one embodiment, the rejects capture and discharge system further includes a pressure control line 80 in fluid communication with the classifier zone 10C and the horizontal conveyor section 50H of the discharge conduit. The pressure control line 80 is configured to decrease pressure in the horizontal conveyor section 50H of the discharge conduit to a magnitude less than that in the grinding zone 10B as a result of the pressure P1 in the classifier zone 10C being less than the pressure P2 in the grinding zone 10B and the pressure P3 in the horizontal conveyor section 50H of the discharge conduit. For example, there is about a 10 inch water column pressure drop differential between P2 and P1. In one embodiment, the pressure control line 80 has a valve 81 positioned therein for controlling pressure in the horizontal conveyor section 50H of the discharge conduit. In one embodiment, the horizontal conveyor section 50H of the discharge conduit includes a clean out port 50C configured for being open to clear any rejects clogged or jammed in the horizontal conveyor section 50H of the discharge conduit. While one valve 81 is shown and described as being positioned in the pressure control line 80, the present invention is not limited in this regard as more than one valve and/or other pressure control devices (e.g., orifices) may be employed. In one embodiment, the pressure control line 80 is in fluid communication with a vacuum source 82. In one embodiment, the vacuum source 82 is in fluid communication with the discharge conduit 70 via the pressure control line 80 and the horizontal conveyor section 50H.

Figure 9:
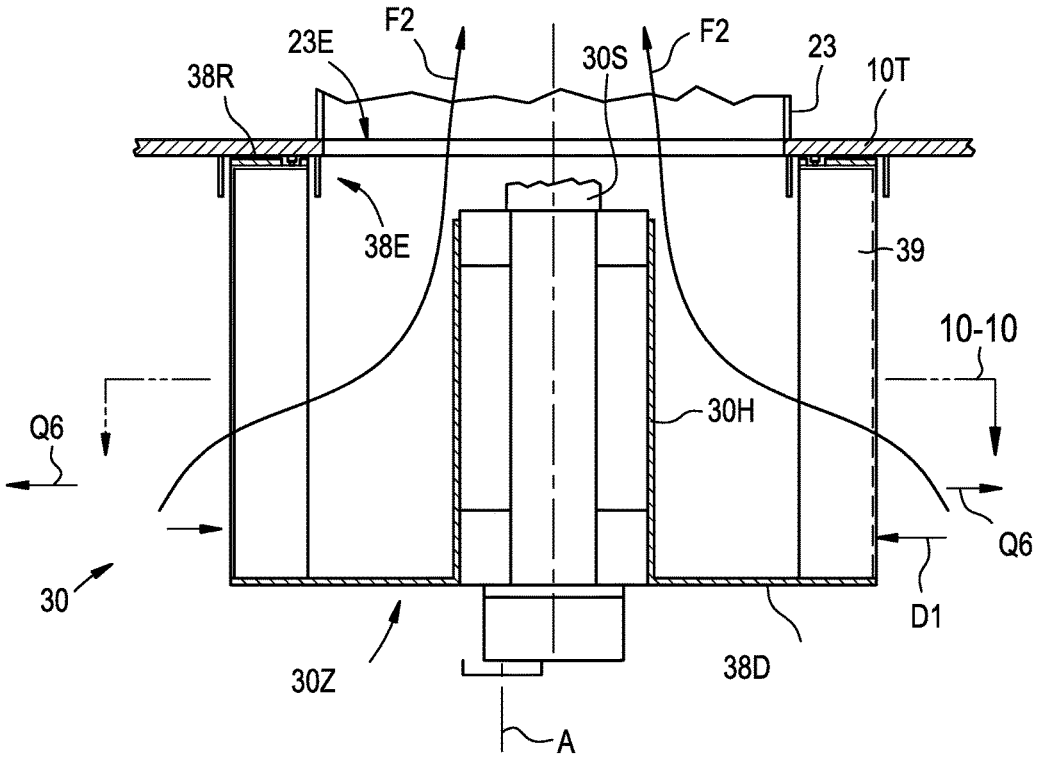
FIG. 9 is an enlarged view of the turbine classifier of FIG. 4.
Figure 10:
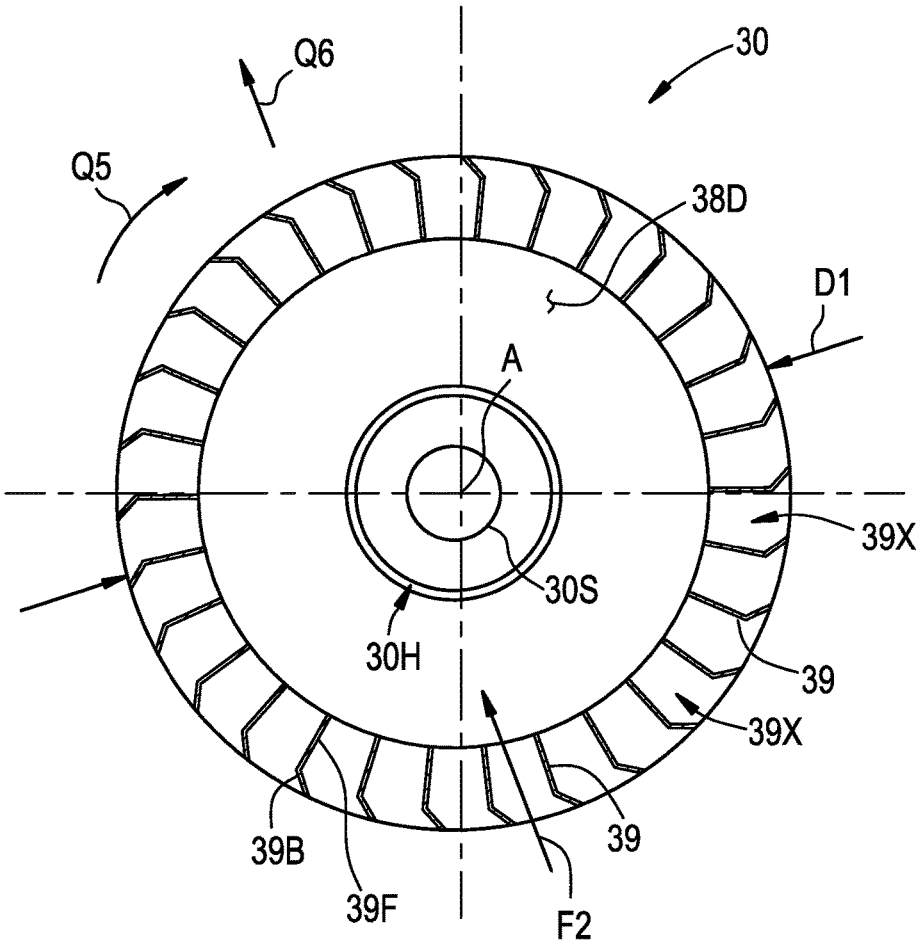
FIG. 10 is a sectional view of the turbine classifier taken across line 10-10 of FIG. 9.

Referring to FIGS. 9 and 10, the turbine classifier 30 includes a plurality of vanes 39 extending (e.g., extending vertically) between and fixedly secured to an annular ring 38R and a solid disc 38D. A central hub 30H is secured to the solid disc 38D and to the drive shaft 30S of the turbine classifier 30. The vanes 39 are arranged radially outward from a central axis A of the annular ring 38R and solid disc 38D. The solid disc 38D blocks flow into a bottom portion 30Z of the turbine classifier 30. The annular ring 38R has opening 38E therein. The opening 38E in the annular ring 38R is aligned with the entrance opening 23E of the discharge duct 23 proximate the top portion 10T of the vessel 10, for discharge of fine ground particles therethrough and into the discharge duct 23. As shown in FIG. 10, each of the vanes 39 has a radially extending portion 39F and circumferentially trailing section 39B. There is a space 39X between each adjacent pair of vanes 39 through which essentially only the fine particles and air pass through as indicated by the arrows F2, as described herein.

As shown in FIGS. 9 and 10, the turbine classifier 30 has an outside diameter D1. As shown in FIG. 4, the side wall 10W of the classifier zone 10C of the vessel 10 has an inside diameter D2. The outside diameter D1 of the turbine classifier 30 is about 40 to 80 percent of the inside diameter D2 of the side wall 10W, to allow adequate space for circulation of the fine particles while being close enough to allow the rejects to be discharged from the classifier zone 10C. In one embodiment, the outside diameter D1 of the turbine classifier 30 is about 55 to 65 percent of the inside diameter D2 of the side wall 10W to allow a more than an adequate space for circulation of the fine particles while being close enough to allow the rejects to be discharged from the classifier zone 10C. In one embodiment, the outside diameter D1 of the turbine classifier 30 is about 60 percent of the inside diameter D2 of the side wall 10W to allow a further more than an adequate space for circulation of the fine particles while being close enough to allow the rejects to be discharged from the classifier zone 10C. In one embodiment, the turbine classifier 30 is spaced apart from the side wall 10W by a distance D3 of about 10 to 30 percent of the first diameter D1. The diameters D1 and D2, the spacing D3 and the above specified ratios thereof are based on CFD analysis to arrive at the specified ranges so that the rejects capture and discharge system is configured remove only those particles (e.g., sand, grit and other materials not intended to be ground) have a density and/or size greater than a predetermined magnitude, for example of a density greater than the fine particles or un-ground material.

Figure 11:
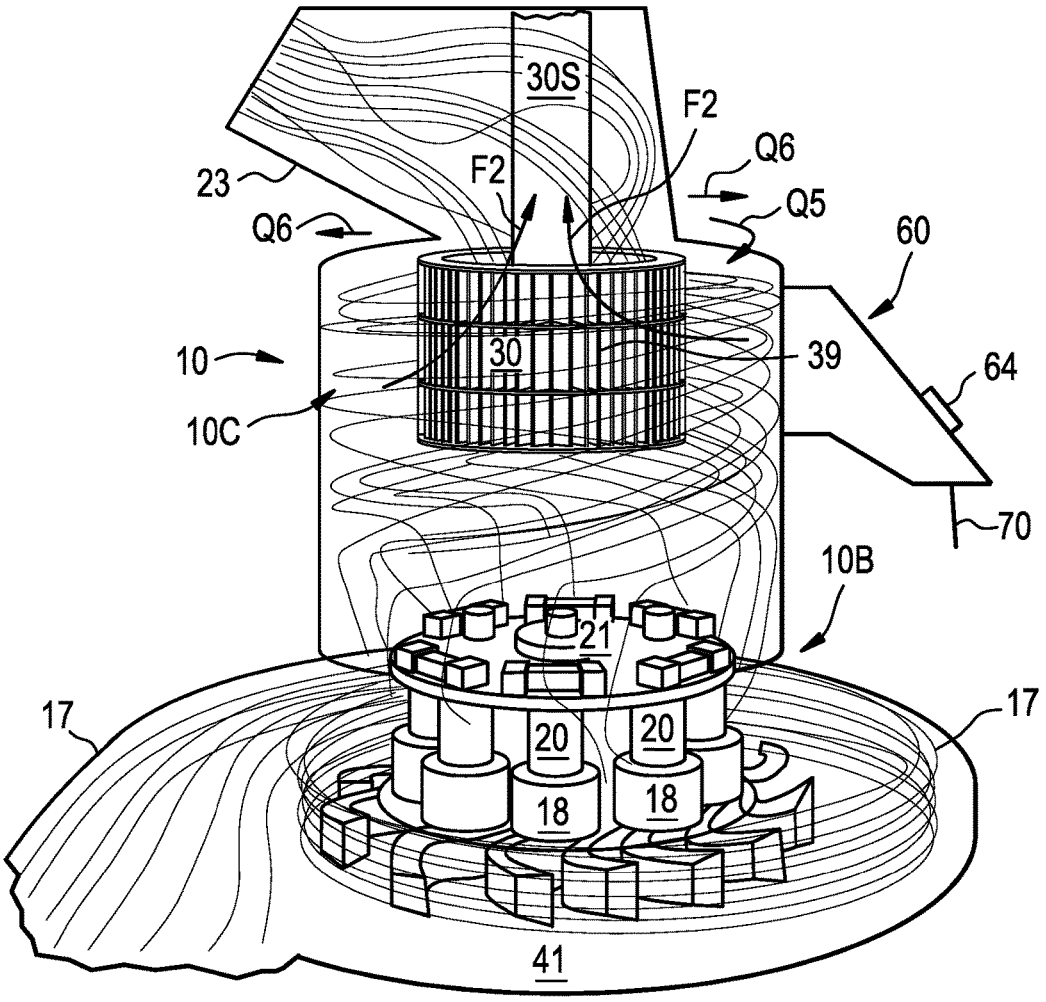
FIG. 11 is a side perspective view of internal portions of the roller mill system of FIG. 4 illustrating flow paths of the particles.
Figure 12:
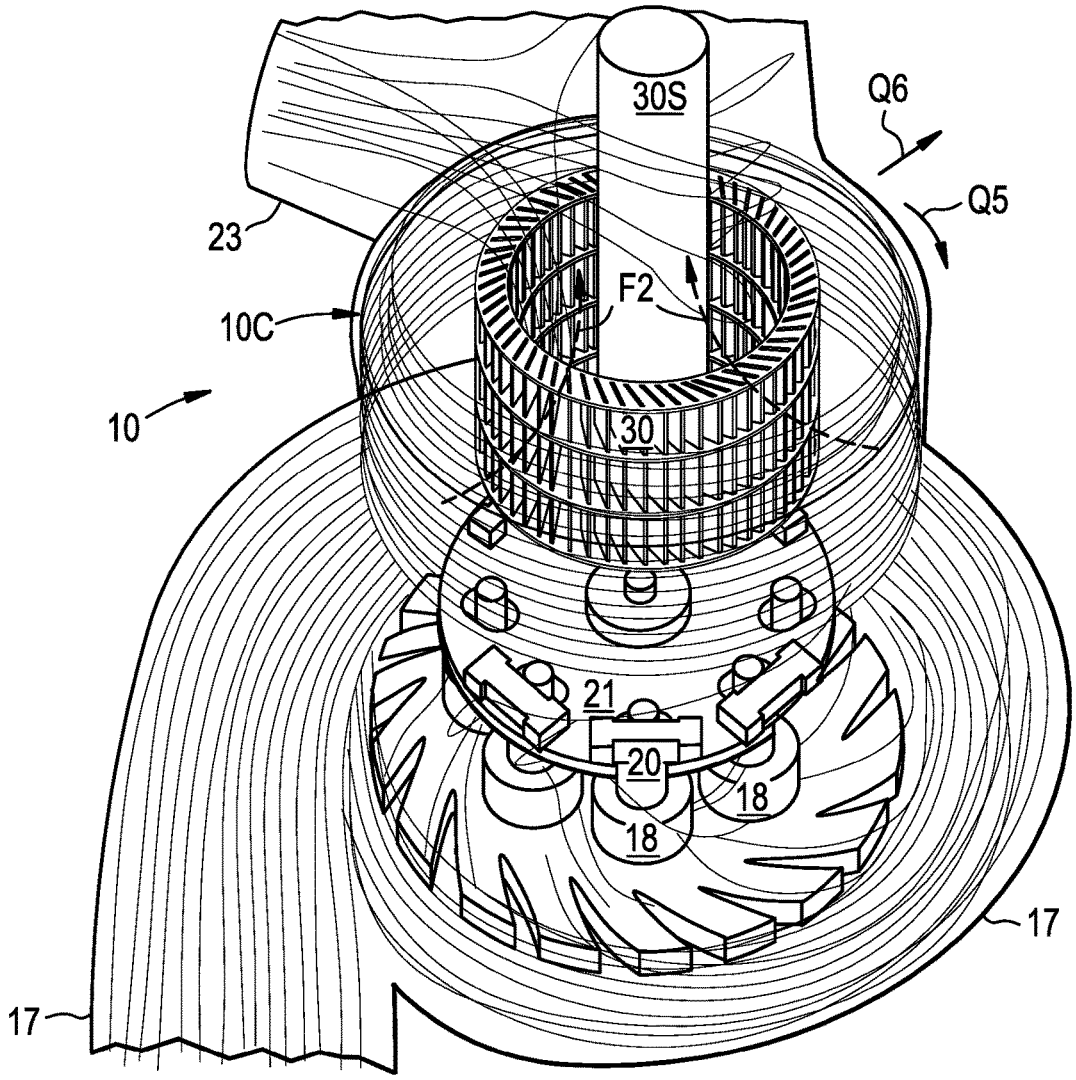
FIG. 12 is a top perspective view of internal portions of the roller mill system of FIG. 4 illustrating flow paths of the particles.

As shown in FIGS. 11 and 12, the Applicant's CFD analysis has shown that the turbine classifier 30 creates a strong swirling flow region upstream of and radially outward of the turbine classifier 30 as shown by the arrows Q5. The Applicant performed testing that demonstrated that the rejects included a mixture containing 40 to 60 weight percent of the undesirable materials (e.g., sand, silica, grit and other large and/or high density particles not intended to be ground). The rejects were discharged radially outward in the direction of the arrows Q6 by centrifugal force before they reach the vanes 39 of the turbine classifier 30. Only small particles may approach and penetrate through the spaces 39X between the blades 39, as indicted by the arrows F2 and exit from the turbine classifier 30 via the discharge duct 23. This results in a discrete differentiation and separation of the rejects and large particles from the fine particles, for example the discharge through the grinding zone discharge conduit 50, the horizontal conveyor section 50H and the rejects collection device 60 discharges rejects mixtures having about 40 to 60 weight percent of the undesirable materials. The swirling of the flow and radially outward separation of the large and high density particles facilitates capture by the scoop 62 and discharge through the rejects collection device 60. In one embodiment, discharge through the rejects collection device 60 is about 6 to 8 percent of the total mass flow of material through the roller mill 1000. In one embodiment, the discharges rejects mixtures having about 40 to 60 weight percent of the undesirable materials was obtained by processing clay through the roller mill 1000, wherein the clay had a 6 wt % of silica.

In one embodiment, testing of the roller mill system 1000 employing the classifier 30 demonstrated that all of the small particles that penetrated through the spaces 39X between the blades 39 and exited the turbine classifier 30 via the discharge duct 23 were 74 microns or less in size. In one embodiment, testing of the roller mill system 1000 employing the classifier 30 demonstrated that 98 to 100 percent of the small particles that penetrated through the spaces 39X between the blades 39 and exited the turbine classifier 30 via the discharge duct 23 were 44 microns or less in size. In one embodiment, testing of the roller mill system 1000 employing the classifier 30 demonstrated that 92 to 98 percent of the small particles that penetrated through the spaces 39X between the blades 39 and exited the turbine classifier 30 via the discharge duct 23 were 25 microns or less in size.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the appended claims.

What is claimed is:

1. A roller mill system for grinding material into fine particles, the roller mill system comprising: a vessel having an inlet and a first outlet, the vessel being configured for flow of a gas from the inlet to the first outlet, the vessel comprising a grinding zone located in a lower portion of the vessel and a classifier zone located downstream of the grinding zone; the grinding zone comprising a grinding assembly configured for grinding the material into fine particles; and a rejects capture and discharge system comprising a first discharge conduit configured to convey rejects away from the vessel, and at least one of: a collection trough located under the grinding assembly and is connected directly to the first discharge conduit, and the first discharge conduit being configured for discharging rejects from the grinding zone; and the grinding zone, the grinding assembly and the classifier zone all coexist in an interior area defined by the vessel; wherein there is a first pressure in the classifier zone that is less than a second pressure in the grinding zone and less than a third pressure in the first discharge conduit, the rejects capture and discharge system further comprises a pressure control line connected to the first discharge conduit, the pressure control line being configured to decrease pressure in the first discharge conduit to a magnitude less than that in the grinding zone, as a result the first pressure being less than the second pressure and less than the third pressure.

2. The roller mill system of claim 1, wherein the pressure control line includes at least one valve therein for controlling pressure in the first discharge conduit.

3. The roller mill system of claim 1, wherein the first discharge conduit of the rejects capture and discharge system comprises a conveyor for urging flow of the rejects out of the first discharge conduit.

4. The roller mill system of claim 3, wherein the conveyor of the rejects capture and discharge system comprises at least one of a vibrator and a rotating screw.

5. The roller mill system of claim 1, wherein the pressure control line is in fluid communication with a vacuum source.

6. The roller mill system of claim 1, wherein the rejects capture and discharge system is configured to remove only those particle having a density or sizes greater than a predetermined magnitude.

7. The roller mill system of claim 1, configured as a pendulum mill comprising:

a bowl assembly mounted in the grinding zone, wherein the grinding assembly is mounted in the grinding zone proximate the bowl assembly;

the grinding assembly comprising a plurality of rollers each mounted on a journal, each of the journals being pivotally connected to a support arms via respective pivot joints;

the support arms being connected for rotation to a drive shaft;

the drive shaft is supported for rotation relative to a frame by a bearing assembly; and the support arms being configured to rotate with the shaft and cause the journals to swing radially outward, thereby causing the rollers to rolling engage a radially inward facing grinding surface of the bowl assembly.

8. The roller mill system of claim 1, wherein the rejects capture and discharge system is configured to convey, away from the vessel, the rejects comprising undesirable materials comprising at least one of high density hard sand, silica and grit particles each having diameters greater than 150 microns that are not intended to be ground.

9. A roller mill system for grinding material into fine particles, the roller mill system comprising:

a vessel having an inlet and a first outlet, the vessel being configured for flow of a gas from the inlet to the first outlet, the vessel comprising a grinding zone located in a lower portion of the vessel and a classifier zone located downstream of the grinding zone;

the grinding zone comprising a grinding assembly configured for grinding the material into fine particles; and a rejects capture and discharge system comprising a discharge conduit configured to convey rejects away from the vessel, and a turbine classifier mounted in the classifier zone and being rotatable about a central axis, a second outlet formed in a side wall of the classifier zone, the discharge conduit being connected to and being downstream of the second outlet, the turbine classifier being configured to expel the rejects radially outward therefrom, through the second outlet and into the discharge conduit; and the grinding zone, the grinding assembly, the classifier zone and the turbine classifier all coexist in an interior area defined by the vessel.

10. The roller mill system of claim 9, wherein the turbine classifier comprises a plurality of vanes extending between an annular ring and a solid disc, the plurality of vanes being arranged radially outward from a central axis of the annular ring and solid disc, the solid disc blocking flow into a bottom portion of the turbine classifier and the annular ring defining an opening therein for discharge of fine ground particles therethrough.

11. The roller mill system of claim 9, further comprising a flow diversion flap moveably secured to the side wall at the second outlet and extending into the classifier zone, the flow diversion flap being configured to divert the rejects through the second outlet thereby exiting the classifier zone.

12. The roller mill system of claim 9, further comprising a duct secured to an outside portion of the side wall, the duct being positioned over the second outlet and located outside of the vessel, to convey the rejects outwardly from the classifier zone.

13. The roller mill system of claim 12, wherein the duct comprises a backflow control damper for controlling flow of the rejects through the duct and to allow the fine particles to flow back into the classifier zone.

14. The roller mill system of claim 12, wherein the duct comprises a plurality of perforated plates located outside of the vessel and positioned in the duct to establish a uniform backflow of the fine particles back into the classifier zone.

15. The roller mill system of claim 9, wherein the turbine classifier has a first diameter and the side wall of the classifier has a second diameter, and the first diameter being about 40 to 80 percent of the second diameter.

16. The roller mill system of claim 9, wherein the rejects capture and discharge system is configured to remove only those particle having a density or sizes greater than a predetermined magnitude.

17. The roller mill system of 9, configured as a pendulum mill comprising:

a bowl assembly mounted in the grinding zone, wherein the grinding assembly is mounted in the grinding zone proximate the bowl assembly;

the grinding assembly comprising a plurality of rollers each mounted on a journal, each of the journals being pivotally connected to a support arms via respective pivot joints;

the support arms being connected for rotation to a drive shaft;

the drive shaft is supported for rotation relative to a frame by a bearing assembly; and the support arms being configured to rotate with the shaft and cause the journals to swing radially outward, thereby causing the rollers to rolling engage a radially inward facing grinding surface of the bowl assembly.

18. The roller mill system of claim 9, wherein the rejects capture and discharge system is configured to convey, away from the vessel, the rejects comprising undesirable materials comprising at least one of high density hard sand, silica and grit particles each having diameters greater than 150 microns that are not intended to be ground.

19. A roller mill system for grinding material into fine particles, the roller mill system comprising:

a vessel having an inlet and a first outlet, the vessel being configured for flow of a gas from the inlet to the first outlet, the vessel comprising a grinding zone located in a lower portion of the vessel and a classifier zone located downstream of the grinding zone;

the grinding zone comprising a grinding assembly configured for grinding the material into fine particles; and a rejects capture and discharge system comprising a first discharge conduit and a second discharge conduit;

the rejects capture and discharge system comprising a collection trough located under the grinding assembly and connected directly to the first discharge conduit and the first discharge conduit being configured for discharging rejects from the grinding zone; and the rejects capture and discharge system comprising a turbine classifier mounted in the classifier zone and being rotatable about a central axis, a second outlet formed in a side wall of the classifier zone, the second discharge conduit being connected to and being downstream of the second outlet, the turbine classifier being configured to expel the rejects radially outward therefrom, through the second outlet and into the second discharge conduit; and the grinding zone, the grinding assembly, the classifier zone and the turbine classifier all coexist in an interior area defined by the vessel.

20. The roller mill system of claim 19, wherein there is a first pressure in the classifier zone that is less than a second pressure in the grinding zone and less than a third pressure in the first discharge conduit, the rejects capture and discharge system further comprises a pressure control line connected to the first discharge conduit, the pressure control line being configured to decrease pressure in the first discharge conduit to a magnitude less than that in the grinding zone, as a result the first pressure being less than the second pressure and less than the third pressure.

21. The roller mill system of claim 20, wherein the pressure control line includes at least one valve therein for controlling pressure in the first discharge conduit.

22. The roller mill system of claim 20, wherein the first discharge conduit of the rejects capture and discharge system comprises a conveyor for urging flow of the rejects out of the first discharge conduit.

23. The roller mill system of claim 22, wherein the conveyor of the rejects capture and discharge system comprises at least one of a vibrator and a rotating screw.

24. The roller mill system of claim 20, wherein the pressure control line is in fluid communication with a vacuum source.

25. The roller mill system of claim 19, wherein the turbine classifier comprises a plurality of vanes extending between an annular ring and a solid disc, the plurality of vanes being arranged radially outward from a central axis of the annular ring and solid disc, the solid disc blocking flow into a bottom portion of the turbine classifier and the annular ring defining an opening therein for discharge of fine ground particles therethrough.

26. The roller mill system of claim 19, further comprising a flow diversion flap moveably secured to the side wall at the second outlet and extending into the classifier zone, the flow diversion flap being configured to divert the rejects through the second outlet thereby exiting the classifier zone.

27. The roller mill system of claim 19, further comprising a duct secured to an outside portion of the side wall, the duct being positioned over the second outlet and located outside of the vessel, to convey the rejects outwardly from the classifier zone.

28. The roller mill system of claim 27, wherein the duct comprises a backflow control damper for controlling flow of the rejects through the duct and to allow the fine particles to flow back into the classifier zone.

29. The roller mill system of claim 27, wherein the duct comprises a plurality of perforated plates located outside of the vessel and positioned in the duct to establish a uniform backflow of the fine particles back into the classifier zone.

30. The roller mill system of claim 19, wherein the turbine classifier has a first diameter and the side wall of the classifier has a second diameter, and the first diameter being about 40 to 80 percent of the second diameter.

31. The roller mill system of claim 19, wherein the rejects capture and discharge system is configured to remove only those particle having a density or sizes greater than a predetermined magnitude.

32. The roller mill system of claim 19, configured as a pendulum mill comprising:

a bowl assembly mounted in the grinding zone, wherein the grinding assembly is mounted in the grinding zone proximate the bowl assembly;

the grinding assembly comprising a plurality of rollers each mounted on a journal, each of the journals being pivotally connected to a support arms via respective pivot joints;

the support arms being connected for rotation to a drive shaft;

the drive shaft is supported for rotation relative to a frame by a bearing assembly; and the support arms being configured to rotate with the shaft and cause the journals to swing radially outward, thereby causing the rollers to rolling engage a radially inward facing grinding surface of the bowl assembly.

* * * * *